US007494001B2

(12) United States Patent
Haruna et al.

(10) Patent No.: US 7,494,001 B2
(45) Date of Patent: Feb. 24, 2009

(54) COIN DEPOSIT APPARATUS

(75) Inventors: Hirohumi Haruna, Muko (JP); Mikio Suzuki, Osaka (JP)

(73) Assignee: Laurel Machinery Co., Ltd., Osaka (JP)

( * ) Notice: Subject to any disclaimer, the term of this patent is extended or adjusted under 35 U.S.C. 154(b) by 0 days.

(21) Appl. No.: 11/525,872

(22) Filed: Sep. 25, 2006

(65) Prior Publication Data

US 2007/0072533 A1 Mar. 29, 2007

(30) Foreign Application Priority Data

Sep. 27, 2005 (JP) ..... P2005-279447

(51) Int. Cl.
*G07F 9/00* (2006.01)
*G07F 9/06* (2006.01)
*G07F 9/10* (2006.01)

(52) U.S. Cl. ..... 194/350

(58) Field of Classification Search ..... 194/350; 902/8–11, 30

See application file for complete search history.

(56) References Cited

U.S. PATENT DOCUMENTS

| | | | | |
|---|---|---|---|---|
| 2,580,752 | A * | 1/1952 | Forester | 232/15 |
| 3,841,550 | A * | 10/1974 | Kaneda et al. | 232/15 |
| 4,889,220 | A * | 12/1989 | Yoshinori et al. | 194/206 |
| 5,224,579 | A * | 7/1993 | Brown | 194/350 |
| 6,039,164 | A * | 3/2000 | Waters et al. | 194/206 |
| 6,082,519 | A | 7/2000 | Martin et al. | |
| 6,991,530 | B2 * | 1/2006 | Hino et al. | 453/3 |
| 2002/0134645 | A1 | 9/2002 | Alexander et al. | |
| 2003/0116623 | A1 | 6/2003 | Park | |
| 2003/0221933 | A1 | 12/2003 | Morikawa | |

FOREIGN PATENT DOCUMENTS

| | | |
|---|---|---|
| DE | 299 13 842 U1 | 11/1999 |
| GB | 2 326 671 A | 12/1998 |
| JP | 11-185111 | 7/1999 |
| JP | 11-339102 | 12/1999 |
| TW | 534402 | 5/2003 |
| TW | 574675 | 2/2004 |
| TW | M271211 | 7/2005 |

OTHER PUBLICATIONS

Office Action and Search Report issued in corresponding Taiwanese Patent Application No. 095130843, issued Jun. 16, 2008, 6 pages including English Translation.

* cited by examiner

*Primary Examiner*—Patrick Mackey
*Assistant Examiner*—Mark Beauchaine
(74) *Attorney, Agent, or Firm*—Nixon & Vanderhye P.C.

(57) ABSTRACT

A coin deposit apparatus has a carriage section having castors detachable from a apparatus main body, and a carriage-locking section which can lock the carriage section attached to the apparatus main body so that a plurality of container sections are mounted onto the carriage section. A shutter which can open and close an upper aperture and a closed position locking member which locks the shutter at the closed position are provided to each one of a plurality of the container sections. A shutter-locking activating section which moves the shutter of a plurality of the container sections mounted onto the carriage section to a closed position and locks the shutter at the closed position by the closed position locking member is disposed in the apparatus main body. By doing this, it is possible to provide the coin deposit apparatus which can prevent problems in security management.

4 Claims, 12 Drawing Sheets

COIN DEPOSIT APPARATUS

The present application is/based on patent application No. 2005-279447 filed in Japan on Sep. 27, 2005, the content of which is incorporated herein by reference.

BACKGROUND OF THE INVENTION

1. Field of the Invention

The present invention relates to a coin deposit apparatus which counts and contains coins.

2. Description of Related Art

Commonly, in coin deposit apparatuses, a significant number of deposited coins, classified by the coin types, are counted and stored temporarily, and the temporarily stored coins are contained in container sections corresponding to the coin types if an approval operation for approving the classification and the result of the counting of coins is input, and the temporarily stored coins are collected, i.e., returned to a collection box if a canceling operation is input. In some coin deposit apparatuses of this type, the container sections corresponding to the coin types have a capacity capable of containing a significant number of coins, and an upper part thereof has openings for receiving the coins from the temporary storage sections (see Japanese Unexamined Patent Application, First Publication No. H111-185111).

Also, in some coin deposit apparatuses of a similar type, if a significant number of coins are deposited and enclosed, and if one of the container boxes enclosing one of the coin types is taken out, carrying it is exhausting because of its weight; therefore, the container sections corresponding to the coin type are mounted on trays detachably from an apparatus main body and capable of running freely thereon, and the container sections, including the trays, corresponding to the coin type can be taken out from the apparatus main body and transported to arbitrary locations (see, for example, Japanese Unexamined Patent Application, First Publication No. H11-339102). Similarly, in this type of coin deposit apparatus, an upper section of each container section having a box shape has an opening for receiving coins from the temporary storage sections.

As explained above, if the container sections, including trays, corresponding to the coin types are taken out from the apparatus main body so that they can be transported to arbitrary locations, the transportation can be easily performed. However, there is likely to be a problem with respect to security management because the upper sections of box-shaped container sections corresponding to coin type have openings.

SUMMARY OF THE INVENTION

Therefore, an object of the present invention is to provide a coin deposit apparatus capable of preventing problems with respect to security management.

In order to achieve the foregoing object, in a first aspect of the present invention, a coin deposit apparatus includes a separating-supplying section for transporting a group of coins, deposited at a time, separately; an identifying section for identifying the type of coin transported by the separating-supplying section; an eliminating section for eliminating the coins rejected based on the identification results made by the identifying section; a distribution section for distributing the coins identified as acceptable based on the identification results made by the identifying section; a plurality of temporary storage sections for storing the coins, selected by the distribution section, temporarily therein; a plurality of container sections having upper openings for receiving the coins from a plurality of the temporary storage sections, so that the received coins are contained in the container sections, a carriage section detachable from a main body of the apparatus, the carriage section having castors, and a plurality of the container sections detachably mounted onto the carriage section; and a carriage-locking section capable of locking the carriage section attached to the apparatus main body. In this aspect, each one of a plurality of the container sections is provided with a shutter capable of opening and shutting the upper opening, and a closed position locking member for locking the shutter in a closed position, and a shutter-locking activating section is provided to the apparatus main body so that each shutter of a plurality of the container sections mounted on the carriage section is moved to the closed position, and the shutter is locked in the closed position by the closed position locking member.

In a second aspect of the present invention, each one of a plurality of the container sections is provided with a force-applying section for moving the shutter to the closed position by applying a force, and an open-position-locking member for locking the shutter at an open position; the carriage section is provided with a plurality of detachable sections onto each of which the container section is mounted separately, each detachable section is provided with a pre-collection lock-releasing section which is engaged with the open-position-locking member of the container section, and the shutter locked by the open-position-locking member in an open position is unlocked by the open-position-locking member; and the shutter-locking activating section of the apparatus main body moves the shutter to the closed position by the force-applying section by activating the pre-collection lock-releasing section of the carriage section and releasing the locked state of the shutter locked in the open position by the open-position-locking member.

In a third aspect of the present invention, each one of a plurality of the container sections is provided with a releasing-movement locking section for locking the releasing of the locked state of the open-position-locking member; and each one of a plurality of the detachable sections of the carriage section is provided with an attached-state-lock-releasing section for releasing the locked state by the releasing-movement locking section by engaging the attached-state-lock-releasing section with the releasing-movement locking section of the container section by attaching the container section to the detachable section.

In a fourth aspect of the present invention, each one of a plurality of the container sections is provided with a shutter-position detecting member, positioned at a detection position, contacting a part of the shutter when the shutter is in an open position; and the apparatus main body is provided with a plurality of detecting sections for detecting as to whether the shutter-position detecting member of a plurality of the container sections mounted on the carriage section is positioned in the detection position; and a control section for locking the carriage section attached to the apparatus main body by the carriage-locking section if the positions of the shutters of all the container sections are detected in the open positions by a plurality of the detecting sections.

In a fifth aspect of the present invention, the control section is provided with a warning section for emitting an alarm if the detection by a plurality of the detecting sections indicates that any one of the shutters of the container sections is not in the open position.

In a sixth aspect of the present invention, the control section releases the locked state between the carriage section and the apparatus main body by the carriage-locking section if the detection by a plurality of the detecting sections indicates that the shutters of all the container sections are not in the open positions.

In a seventh aspect of the present invention, the control section is provided with a notifying section for notifying that the carriage section may be taken out if the locked state between the carriage section and the apparatus main body by the carriage-locking section is released.

In an eighth aspect of the present invention, each one of the plurality of the container sections is provided with a key section capable of engaging with the closed position locking member; capable of releasing the locked state of the shutter in the closed position by the closed position locking member; and capable of being controlled externally.

In a ninth aspect of the present invention, each one of a plurality of the container sections is provided with a key section capable of engaging with the closed position locking member, capable of releasing the locked state of the shutter in the closed position by the closed position locking member, and capable of being controlled externally; and a connecting section for releasing the locked state of the open-position-locking member by the releasing-movement locking section in connection with releasing the locked state of the shutter in the closed position by the closed position locking member.

According to the first aspect of the present invention, after the acceptable coins are distributed by the distribution section and stored in the plurality of the temporary storage sections temporarily, the coins are contained in a plurality of the container sections. Since these container sections are mounted onto the carriage section having castors so that the container sections are detachable from the apparatus main body and from the apparatus main body, it is possible to transport these container sections to arbitrary locations by taking out a plurality of the container sections together with the carriage section from the apparatus main body and moving the carriage section having the castors. During such transportation, since the shutter-locking activating section disposed in the apparatus main body moves the shutters which can open and close the upper openings of a plurality of the container sections mounted on the carriage section to the closed position, and since the shutters are locked in the closed positions by the closed position locking member, the shutters can be locked so that the upper openings of the container sections are shut; therefore, if the locked state of the carriage section attached to the apparatus main body by the carriage-locking section is released after that, it is possible to prevent problems occurring in security management.

According to the second aspect of the present invention, in the container sections mounted onto the carriage section, since the shutters are locked in the open positions by the open-position-locking member, and the upper openings of the container sections are opened, the coins can be received from the temporary storage sections. On the other hand, if the shutter-locking activating section of the apparatus main body activates the pre-collection lock-releasing section of the carriage section from such a state, the pre-collection lock-releasing section engages with the open-position-locking members of the container sections, and the locked state of the shutter in the open position by the open-position-locking member is released. Consequently, the force-applying section moves the shutter to the closed position, and the shutter moved in this manner is locked in the closed position by the closed position locking member activated by the shutter-locking activating section. After that, if the locked state of the carriage section attached to the apparatus main body by the carriage-locking section is released, it is possible to prevent a problem occurring in security management. In addition, if the shutter-locking activating section disposed near the apparatus main body is activated, this engages the pre-collection lock-releasing section of the carriage section with the open-position-locking member of the container section, and the locked state of the shutter in the open position is released. As a result, the shutter can be moved to the closed position by a force applied by the force-applying section and can be locked there. Therefore, the shutter which has previously been disposed in the open position can be moved and locked in the moved position using a simple structure.

According to the third aspect of the present invention, since the releasing-movement locking section disposed in each one of a plurality of the container sections locks the releasing movement with respect to the locked state by the open-position-locking member, for example, it is possible to double-lock the open state of the shutter in the container section taken out from the carriage section by the open-position-locking member and the releasing-movement locking section; thus, it is possible to prevent the opened shutter from being shut due to unexpected factors, e.g., collision or erroneous operation. Also, if the container section is attached to the detachable section of the carriage section, since the locked state of this releasing-movement locking section is released because the releasing-movement locking section engages with the attached-state-lock-releasing section disposed on the detachable section, the locked state can be released sequentially in connection with the attaching of the container section. After the locked state is released, the shutter is locked only by the open-position-locking member, and it is possible to release the locked state by the shutter-locking activating section.

According to the fourth aspect of the present invention, the control section of the apparatus main body locks the carriage section attached to the apparatus main body by the carriage-locking section when the shutter-position detecting member, disposed in each one of the plurality of the container sections, indicates that the shutters of all the container sections attached to the detachable sections of the carriage section are disposed in the open positions; therefore, for example, in the case of attaching vacant container sections to the apparatus main body via the carriage section, if the carriage section is locked onto the apparatus main body, shutters in all the container sections are opened; thus, it is possible to receive coins. In this way, the carriage section can be locked to the apparatus main body only if coins can be received in a state where the shutters in all the container sections are in open condition.

According to the fifth aspect of the present invention, if the detection by a plurality of the detecting sections indicates that any shutter in the container sections is not in the open position, the warning section emits an alarm, and an operator can be notified of the situation.

According to the sixth aspect of the present invention, the control section of the apparatus main body releases the locked state between the carriage section and the apparatus main body by the carriage-locking section if the detection by the detecting sections of the shutter-position detecting member disposed in a plurality of the enclosing sections indicates that the shutters of all the container sections are not in the open positions. Therefore, for example, even if the shutter-locking activating section of the apparatus main body releases the locked state of the shutter in the open position by the open-position-locking member of the container section by the pre-collection lock-releasing section of the carriage section in order to collect the container sections, an alarm indicating that the shutting movement of the shutter is not carried out correctly is sounded if a shutter of any one of the container sections is in the open position; therefore, the operator can acknowledge this alarm reliably.

According to the seventh aspect of the present invention, if the locked state between the carriage section and the apparatus main body by the carriage-locking section is released, the control section notifies that the carriage section may be taken out by using the notifying section; therefore, the operator can acknowledge this alarm reliably. Accordingly, the container sections mounted onto the carriage section can be moved to a predetermined location quickly and safely.

According to the eighth aspect of the present invention, the container section having the closed and locked shutter is taken out from the apparatus main body via the carriage section, and for example, the container section is moved to a desirable location, and after that, the locked state of the shutter in the closed position by the closed position locking member is released by the key section, which can be operated externally. By doing this, the shutter can be opened; thus, the coins in the container section can be collected.

According to the ninth aspect of the present invention, the container section having the closed and locked shutter is taken out from the apparatus main body via the carriage section, and for example, the container section is moved to an arbitrary location by the carriage section, and after that, the locked state of the shutter at the closed position by the closed position locking member is released by the key section, which can be operated externally. By doing this, the shutter can be opened, and in connection with this, since the locked state of the releasing-movement locking section, which locks the open-position-locking member, can be released, it is possible to operate the open-position-locking member and it is possible to lock the opened shutter in an opened state.

BRIEF DESCRIPTION OF THE DRAWINGS

FIG. 10A is a plan view, FIG. 10B is a cross section of a side view, and FIG. 10C is a cross section of a rear view.

DETAILED DESCRIPTION OF THE INVENTION

An embodiment of a coin deposit apparatus according to the present invention is explained as follows with reference to drawings.

Figure 1:
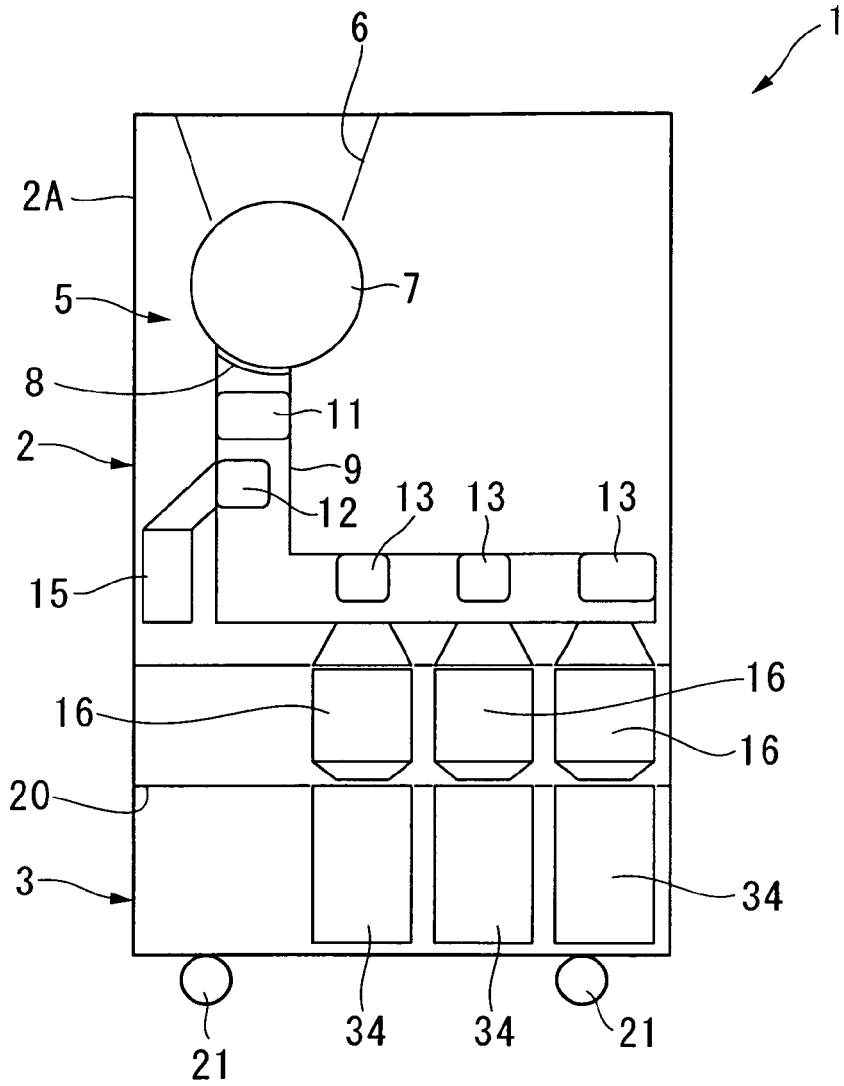
FIG. 1 is a side view showing a general structure of a coin deposit apparatus according to an embodiment of the present invention.

FIG. 1 shows a general structure of a coin deposit apparatus 1 of the present embodiment in which the coin deposit apparatus 1 has an apparatus main body 2, and a carriage section 3 which can be attached to this apparatus main body 2 detachably. In the following explanation, directions regarding the coin deposit apparatus 1 indicating a front side, rear side, right-hand side, and left-hand side are based on a viewer's view of the drawings.

A separating-supplying section 5 for separately transporting a group of coins deposited at a time is provided at an upper section of the apparatus main body 2. This separating-supplying section 5 has a hopper 6 into which various types of coins are deposited at a time, a rotative round plate 7 which can rotate horizontally to form a bottom section beneath the hopper 6, a coin-separating section 8 having an aperture through which only a piece of coin can pass to feed coins one by one by centrifugal force generated by rotating the rotative round plate 7, and a coin-transferring section 9 which transports coins horizontally fed one by one by the coin-separating section 8.

Also, in the apparatus main body 2, an identifying section 11 is disposed upstream of the coin-transferring section 9 for identifying the coins transported by the coin-transferring section 9 as to whether the coin is fake or not and as to the coin type, a rejecting section 12 is disposed downstream of this identifying section 11 in the coin-transferring section 9 for eliminating the coins rejected because they are identified as non-authentic coins based on the identification results by the identifying section 11, and in addition, a plurality of, more specifically three distribution sections 13, 13, 13 are disposed downstream of the rejecting section 12 in the coin-transferring section 9 along a direction of transportation by the coin-transferring section 9 for distributing the coins identified as acceptable because they are authentic coins based on the identification results from the identifying section 11.

Also, the apparatus main body 2 has a rejected-coin box 15 for accepting the coins rejected by the rejecting section 12 via the coin-transferring section 9, and a plurality of, more specifically, three temporary storage sections 16, 16, 16 for storing the coins distributed by each distribution section 13 temporarily so that the temporary storage sections correspond to the distribution sections 13 one by one. The temporary storage sections 16, 16, 16 are taken out from the apparatus main body 2 when the temporarily stored coins are returned.

The carriage section 3 is projected out to a front surface 2A with respect to the apparatus main body 2 via the loading-aperture section 20 disposed on the front surface 2A of the apparatus main body 2 and detached from the apparatus main body 2. On the other hand, it is possible to be attached to the apparatus main body 2 by attaching it from the front surface 2A, that is, the carriage section 3 is attachable and detachable with respect to the apparatus main body 2.

Figure 2:
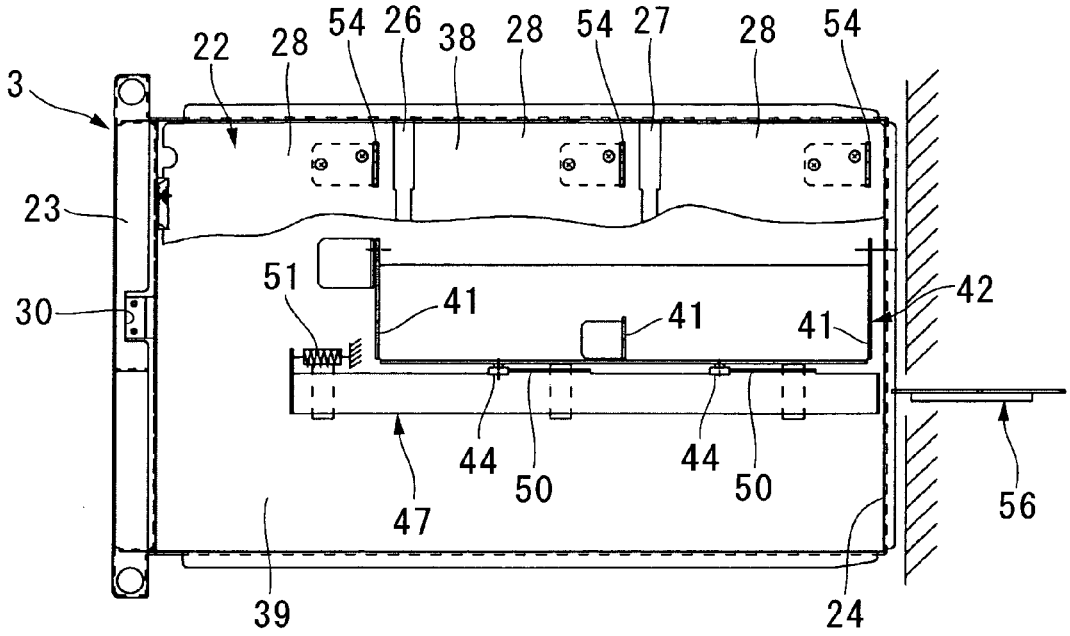
FIG. 2 is a plan view showing a carriage section of the coin deposit apparatus according to the embodiment of the present invention.
Figure 3:
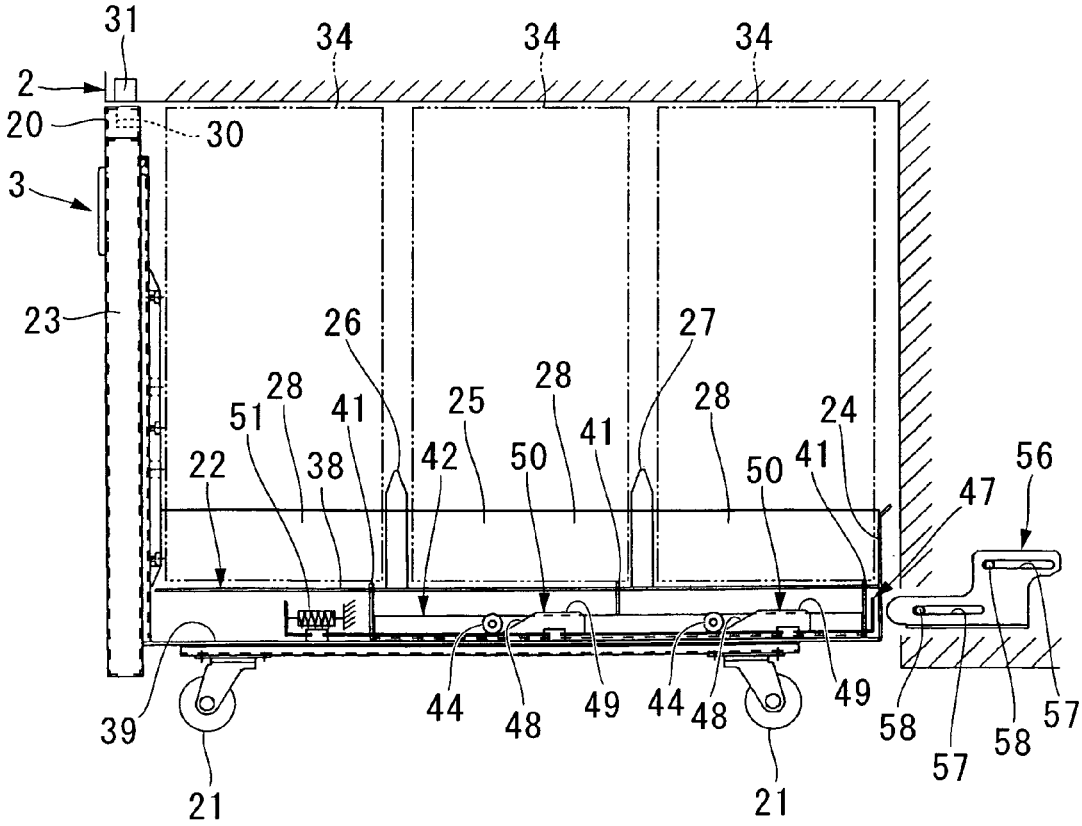
FIG. 3 is a cross section of a side view showing the carriage section of the coin deposit apparatus according to the embodiment of the present invention.
Figure 4:
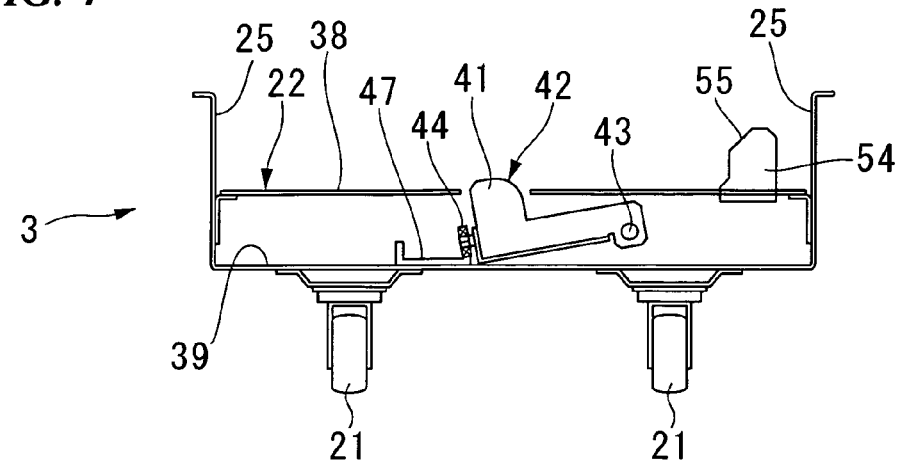
FIG. 4 is a cross section of a rear view showing the carriage section of the coin deposit apparatus according to the embodiment of the present invention.

As shown in FIGS. 2 to 4, the carriage section 3 has a mounting-base section 22 having castors 21 disposed therebeneath, by which the carriage section 3 can be disposed on a floor surface approximately horizontally, which can rotate thus enabling the carriage section 3 to run; a front plate section 23 which projects from a marginal section of the mounting-base section 22 vertically so that the front plate section 23 closes the loading-aperture section 20 of the apparatus main body 2 in a state in which the carriage section 3 is attached to the apparatus main body 2; a rear plate section 24 which projects vertically from another marginal section of the mounting-base section 22; a pair of side plate sections 25 that project from both left-hand and right-hand marginal sections of the mounting-base section 22 vertically so that two separating walls 26, 27 are disposed on the mounting-base section 22 in parallel with the front plate section 23 and the rear plate section 24 to separate the mounting-base section 22 into three equal portions. By doing this, three detachable sections 28, 28, 28 are formed on the mounting-base section 22 so that each section 28 is disposed between the front plate section 23 and the separating wall 26 near the front plate section 23, between both separating walls 26, 27, and between the separating wall 27 near the rear plate section 24 and the rear plate section 24. On the apparatus main body 2, a carriage-locking section 31 is disposed which locks the carriage section 3 attached to the apparatus main body 2 so as not to be detachable by engaging with the locking concave section 30 formed on an upper end section of the front plate section 23 of the carriage section 3 in a state where the carriage section 3 is attached; and which releases the engagement to the locking concave section 30 so as to enable the carriage section 3 to be detached from the apparatus main body 2.

Figure 5:
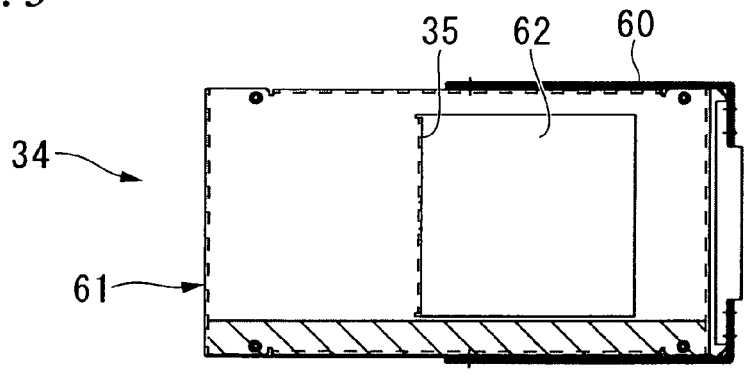
FIG. 5 is a plan view showing a container box of the coin deposit apparatus according to the embodiment of the present invention.
Figure 6:
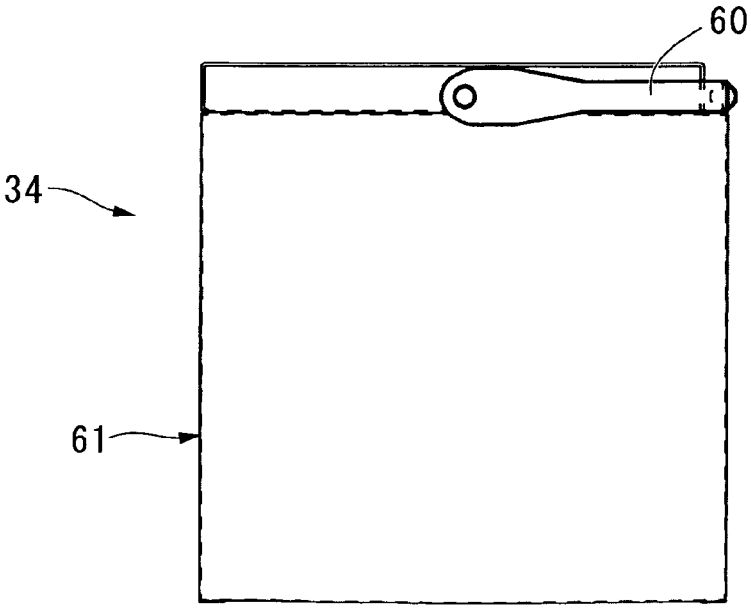
FIG. 6 is a side view showing the container box of the coin deposit apparatus according to the embodiment of the present invention.
Figure 7:
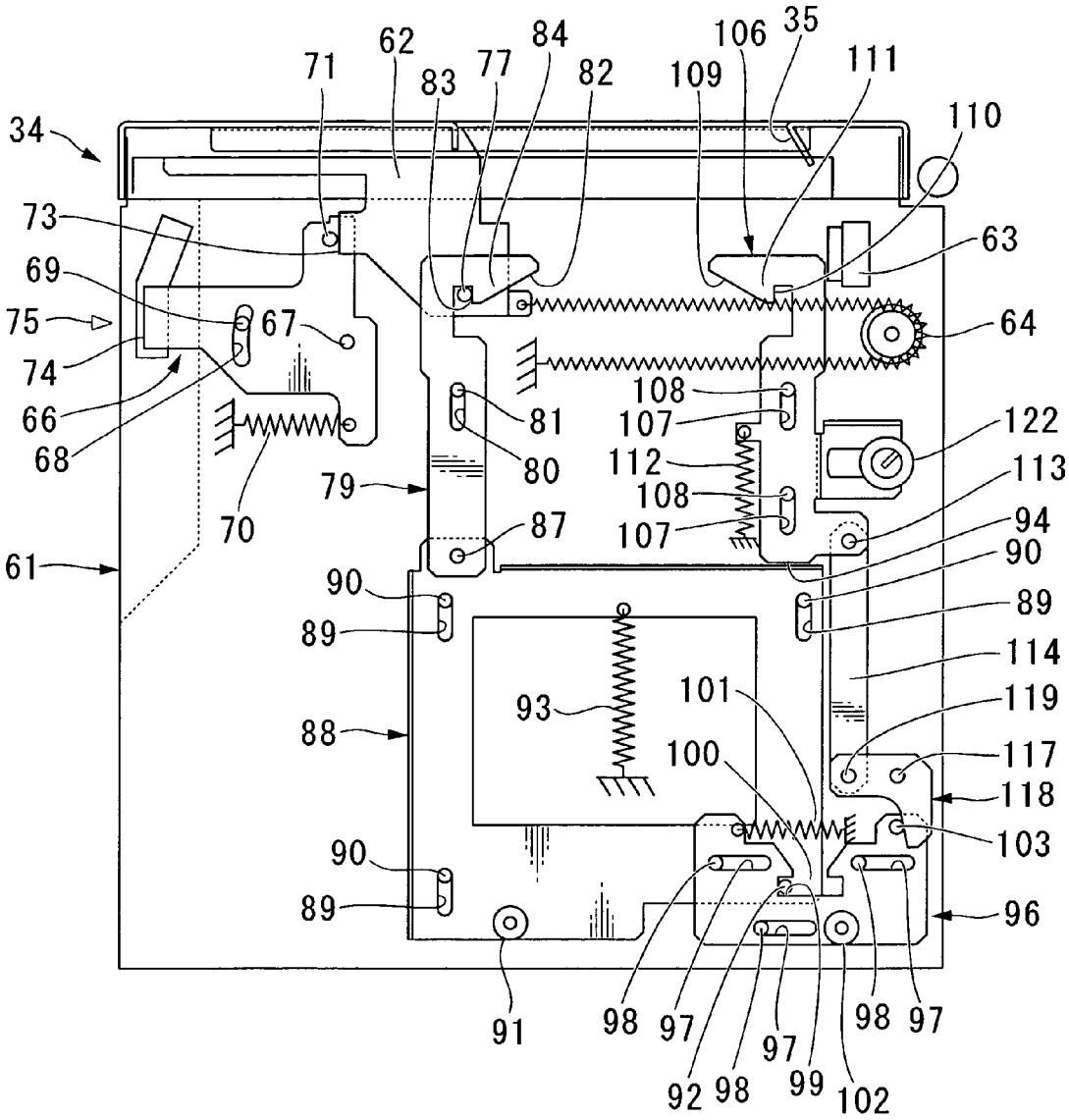
FIG. 7 is a cross section of a side view of the container box of the coin deposit apparatus having a shutter locked at an open position according to the embodiment of the present invention.

Container boxes 34 are mounted onto each detachable section 28, 28, 28 as shown in FIGS. 5 to 7 so as to be attachable and detachable separately. Here, as shown in FIG. 1, a plurality of, more specifically, three container boxes 34 disposed on the carriage section 3 are disposed vertically beneath each of the temporary storage sections 16, 16, 16 of the foregoing apparatus main body 2 one by one in a state where the carriage section 3 is attached in the apparatus main body 2 so that the coins temporarily stored in each temporary storage section 16 are accepted from the upper aperture 35 shown in FIG. 5 so as to enclose therein.

As shown in FIGS. 2 to 4, the mounting-base section 22 has a carriage plate 38 onto which the container box 34 is mounted and a bottom plate 39 which is disposed beneath the carriage plate 38 so that, between these plates, a lock-releasing member 42 which has three lock-releasing piece sections (post-collection lock-releasing section) 41, 41, 41 disposed projecting in parallel with a rear plate section 24 near each one of the detachable sections 28, 28, 28 is disposed so as to rotate around a rotational shaft 43 along the front-rear direction. Rollers 44 are disposed at two locations rotatively along a direction orthogonal to the rotational shaft 43 opposite to the rotational shaft 43 of this lock-releasing member 42.

Also, a sliding piece 47 which can slide with respect to a front-rear direction is disposed next to the rollers 44 of the lock-releasing member 42 on the bottom plate 39. Cam sections 50 which have an inclination surface 48 and a top surface 49 are formed next to each of the rollers 44 on this sliding piece 47, and in addition, a sliding spring 51 for applying a rearward force to this is disposed on the sliding piece 47. Furthermore, attached-state-lock-releasing pieces 54, 54 are disposed on each one of the detachable sections 28, 28, 28 so as to correspond to be above each carriage plate 38 so that the attached-state-lock-releasing pieces 54, 54 are disposed to be in parallel with the rear plate section 24 so as to face toward the rear plate section 24.

Here, lock-release driving pieces (shutter lock operating section) 56, 56 are disposed in the apparatus main body 2 for pressing the sliding piece 47 frontward. Each lock-release driving piece 56 has upside and downside guide grooves 57, 57 disposed along the front-rear direction so as to be movable along the front-rear direction guided by pins 58, 58 driven to move along the front-rear direction by a solenoid mechanism not shown in the drawings. If the lock-release driving pieces 56, 56 are moved frontward, the sliding piece 47 slides so as to resist the force applied by the sliding spring 51, both of the cam sections 50, 50 move frontward, as a result of that, the rollers 44 of the lock-releasing member 42 are raised, the lock-releasing member 42 swings around the rotational shaft 43, and the lock-releasing piece sections 41, 41, 41 disposed opposite to the rotational shaft 43 protrude upwardly from the carriage plate 38.

In contrast, if the lock-release driving pieces 56, 56 move rearward from this state, the sliding piece 47 slides rearward by the force applied by the sliding spring 51, and both of the cam sections 50, 50 retract, as a result of that, the rollers 44 of the lock-releasing member 42 descend, and the lock-releasing piece sections 41, 41, 41 of the lock-releasing member 42 descend accordingly.

Since each container box 34 disposed onto each one of the detachable sections 28, 28, 28 at three locations is configured to be the same as each other, only one of them is explained in detail as follows. As shown in FIGS. 5 and 6, the container box 34 contains the coins deposited through an upper aperture 35 formed on an upper section of the box main body 61 having a handling section 60 which can rotate on the box main body 61, and a shutter 62 which opens and closes the upper aperture 35 is supported slidably with respect to the left-hand and right-hand direction on the box main body 61. The shutter 62 slides toward a minus direction with respect to the left-hand and right-hand direction and opens the upper aperture 35. On the other hand, the shutter 62 slides toward the opposite direction until contacting the stopper 63 of the box main body 61 as shown in FIG. 7 and closes the upper aperture 35. Here, the following members are disposed relating to the locking of the shutter 62 so that the members are disposed at a minus side (hatched sections shown in FIG. 5) of the left-hand and right-hand direction with respect to the coin-enclosing space beneath the shutter 62.

FIG. 7 shows an open state in which a shutter spring (force-charging section) 64 for applying a force to the shutter 62 to a closed position where the upper aperture 35 is closed between the shutter 62 and the box main body 61.

Also, a shutter-position detecting member 66 rotative around a rotational shaft 67 extending in the front-rear direction is disposed nearer an open side of the shutter 62 than the shutter 62 in the box main body 61. A guide groove 68 having an arc shape around the rotational shaft 67 is formed opposite to the upper aperture 35 of the rotational shaft 67 with respect to the left-hand and right-hand direction of the shutter-position detecting member 66. A pin 69 is inserted in this guide groove 68 in parallel with the rotational shaft 67 in the box main body 61 so that the guide groove 68 of the shutter-position detecting member 66 can swing with reference to the pin 69. A spring 70 for applying a force to a lower section of the shutter-position detecting member 66 opposite to the upper aperture 35 with respect to the left-hand and right-hand direction is disposed between the lower section of the shutter-position detecting member 66 and the box main body 61.

Furthermore, in a state in which the shutter-position detecting member 66 is separate from the shutter 62, the pin 69 is disposed at a lower end of the guide groove 68 by a force applied by the spring 70, and if the shutter 62 moves to the open position, a pin 71, disposed above the rotational shaft 67 and in parallel with the rotational shaft 67, is pushed by an operational piece section 73 of the shutter 62 disposed at the open position; by doing this, the pin 69 rotates so as to be located above the guide groove 68 (in a state shown in FIG. 7). By doing this, a detecting piece section 74 of the shutter-position detecting member 66 disposed at an end section opposite to the upper aperture 35 descends in a state in which the shutter 62 is at the open position, and the detecting piece section 74 is raised by the force applied by the spring 70 in another state. Furthermore, a sensor (detecting section) 75 having a reflection optical system for detecting whether the shutter 62 is positioned at the open position by detecting the detecting piece section 74 descending below the shutter-position detecting member 66 is disposed in the apparatus main body 2 so that the detecting piece section 74 corresponds to each container box 34 one by one mounted on the detachable section 28.

An open-position-locking member 79 for locking the shutter 62 at the open position is disposed in the box main body 61 by engaging with a pin 77 protruding from a lower section of the shutter 62 in parallel with the rotational shaft 67. This open-position-locking member 79 is configured to move in the vertical direction with respect to the box main body 61 only in a predetermined range by a guide groove 80 formed on the open-position-locking member 79 and extending in the vertical direction and a support pin 81, engaging with the guide groove 80, nearer to the box main body 61 in parallel with the pin 77 so that, on an upper section of the open-position-locking member 79, a hook section 84 is formed which has a lower inclination surface 82 which guides the pin 77 of the shutter spring 70 moving to an opening direction and an engaging concave section 83, having an upward notch from a base end of the lower inclination surface 82, which engages with the pin 77 disposed at the open position.

A movable plate (open-position locking member) 88 is connected to a lower end section of the open-position-locking member 79 via a connecting pin 87 which is parallel with a support pin 81 rotatively. This movable plate 88 is configured to be movable vertically with respect to the box main body 61 only in a predetermined range by a plurality of guide grooves 89, 89 formed on this movable plate 88, extending vertically and support pins 90, 90, engaging with these guide grooves 89, 89, nearer to the box main body 61 in parallel with the connecting pin 87 so that a movable roller 91 is disposed in a lower section thereof in parallel with the support pins 90, 90. Also, a pin 92 in parallel with the support pins 90, 90 is disposed to protrude on a lower end portion of the movable plate 88 opposite to the movable roller 91, and a contacting section 94 is formed so as to extend horizontally thereabove. In this state, a movable-plate spring 93 is disposed between the movable plate 88 and the box main body 61 for applying a downward force onto the movable plate 88.

A releasing-movement locking member 96 which can engage with this pin 92 is disposed on a portion of the movable-plate 88 nearer the pin 92 so as to slide in the left-hand and right-hand direction freely. That is, this releasing-movement locking member 96 is configured to be movable with respect to the box main body 61 in the left-hand and right-hand direction freely only in a predetermined range by a plurality of guide grooves 97, formed on this releasing-movement locking member 96, extending in the left-hand and right-hand direction and a plurality of support pins 98 in parallel with the pin 92 engaging with these guide grooves 97 nearer the box main body 61. In a central portion in the left-hand and right-hand direction of the releasing-movement locking member 96, an insertion-opening section 100 is formed having an opening which opens upwardly and engaging convex section 99 notched horizontally therebeneath so that the pin 92 can be engaged with the engaging convex section 99. Also, a spring 101 for generating a force in a direction which engages the pin 92 with the engaging convex section 99 is disposed between the releasing-movement locking member 96 and the box main body 61. Also, a movable roller 102 is disposed in a lower section of the releasing-movement locking member 96 so as to rotate freely in parallel with the pin 92, and a pin 103 above the movable roller 102 in parallel with the pin 92 is disposed to protrude there separately from the movable plate 88.

A closed position locking member 106, locking the shutter 62 in the closed position by engaging with the foregoing pin 77 disposed in a lower section of the shutter 62, is provided in parallel with the open-position-locking member 79 in the box main body 61. This closed position locking member 106 is configured to be movable vertically with respect to the box main body 61 in only a predetermined range by a plurality of guide grooves 107, formed on this closed position locking member 106, extending vertically and support pins 108, engaging with these guide grooves 107, nearer to the box main body 61 in parallel with the connecting pin 77 so that a lower section of the closed position locking member 106 can contact the contacting section 94 in an upper section of the movable plate 88 from upward. A hook section 111, having an lower inclination surface 109 and an engaging concave section 110 is disposed in the upper section of this closed position locking member 106 so that the hook section 111 is disposed horizontally symmetrically in the drawings so as to face to the hook section 84 of the open-position-locking member 79, and the engaging concave section 110 engages with the pin 77 disposed at the closed position, and the engaging concave section 110 has notches receding upwardly from the base end of the lower inclination surface 109.

A spring 112 for applying a downward force to compress the closed position locking member 106 is disposed between the closed position locking member 106 and the box main body 61 so that an end of a link (connecting section) 114 is connected to a lower section of this closed position locking member 106 via a connecting pin 113 which is parallel with the support pins 108, 108 rotatively. An end section of a releasing piece (connecting section) 118, supported on the box main body 61 via a rotational shaft 117 disposed in parallel with the connecting pin 113, is connected to the other end of this link 114 rotatively via a connecting pin 119 disposed in parallel with the rotational shaft 117, and the other end of this releasing piece 118 which extends downward from the rotational shaft 117 is disposed to contact the pin 103 of the releasing-movement locking member 96.

A key cylinder (key section) 122, into which a separate key is inserted so as to be operated externally is disposed in a horizontal near space of the closed position locking member 106. The key cylinder 122 can raise and lower the closed position locking member 106 if this key cylinder 122 is operated by a separate key which can contact a part of the closed position locking member 106 from beneath.

Figure 8:
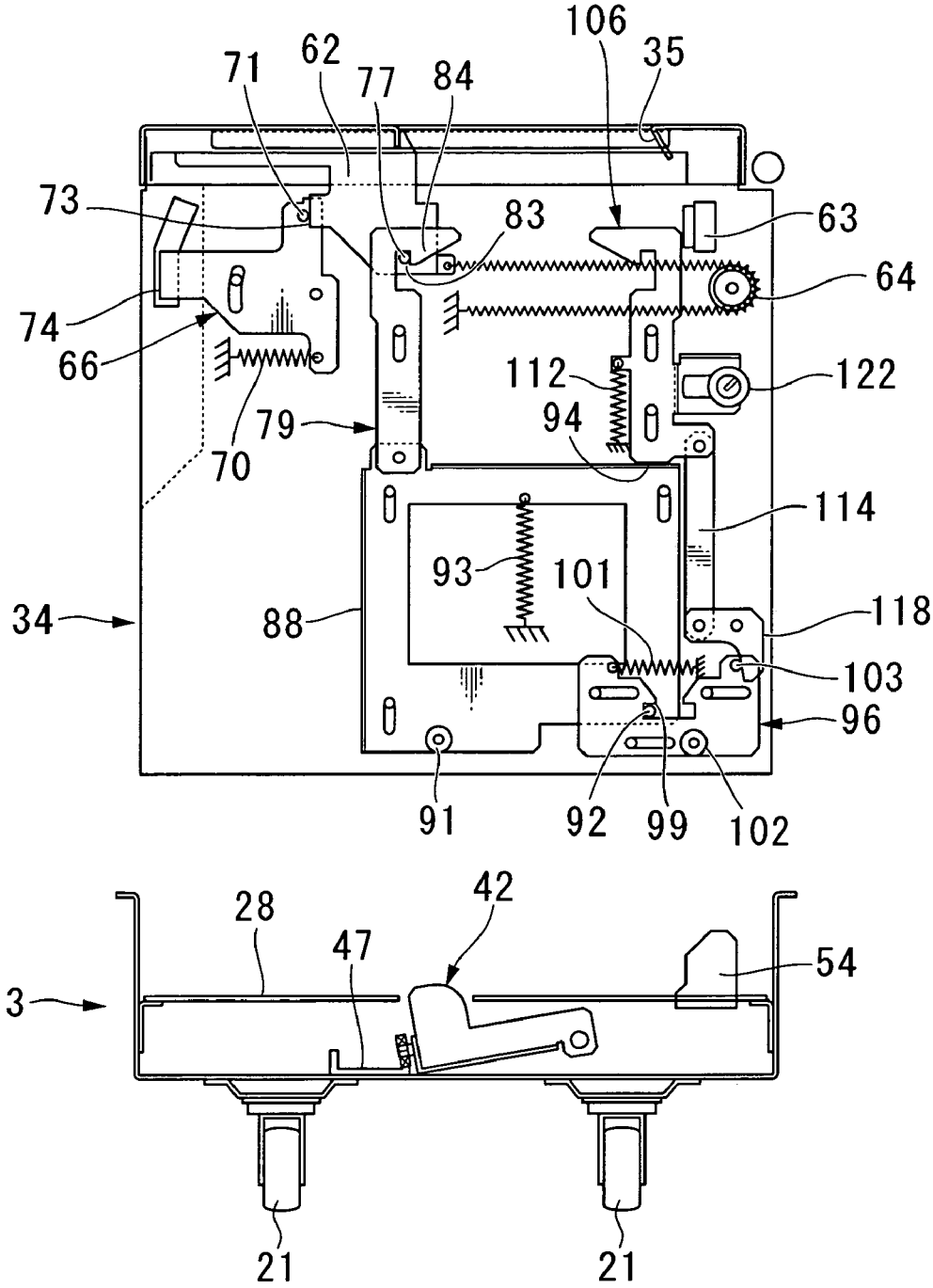
FIG. 8 is a cross section of a rear view showing the carriage section and the container box of the coin deposit apparatus prior to attaching the container box thereto according to the embodiment of the present invention.

In the above-explained container box 34 as shown in, for example, FIG. 8, in a state where the container box 34 is detached from the carriage section 3, the coins inside thereof are collected, the shutter 62 opens, and the engaging concave section 83 of hook section 84 is engaged with the pin 77 of the shutter 62 having the open-position-locking member 79 at the open position. In this state, since the open-position-locking member 79 is pushed downward by the movable-plate spring 93 via the movable plate 88, the locked state of shutter 62 is maintained by this downward force. Also, in this state, since the releasing-movement locking member 96 engages the engaging convex section 99 with the pin 92 of the movable plate 88, upward movement of the pin 92 is limited by an upper surface of the engaging convex section 99, upward movement of the movable plate 88 is limited, and upward movement of the open-position-locking member 79 is also limited; thus, the shutter 62 is double-locked.

That is, the releasing-movement locking member 96 locks the upward movements, i.e., lock-releasing movements of the movable plate 88 and open-position-locking member 79.

Figure 9:
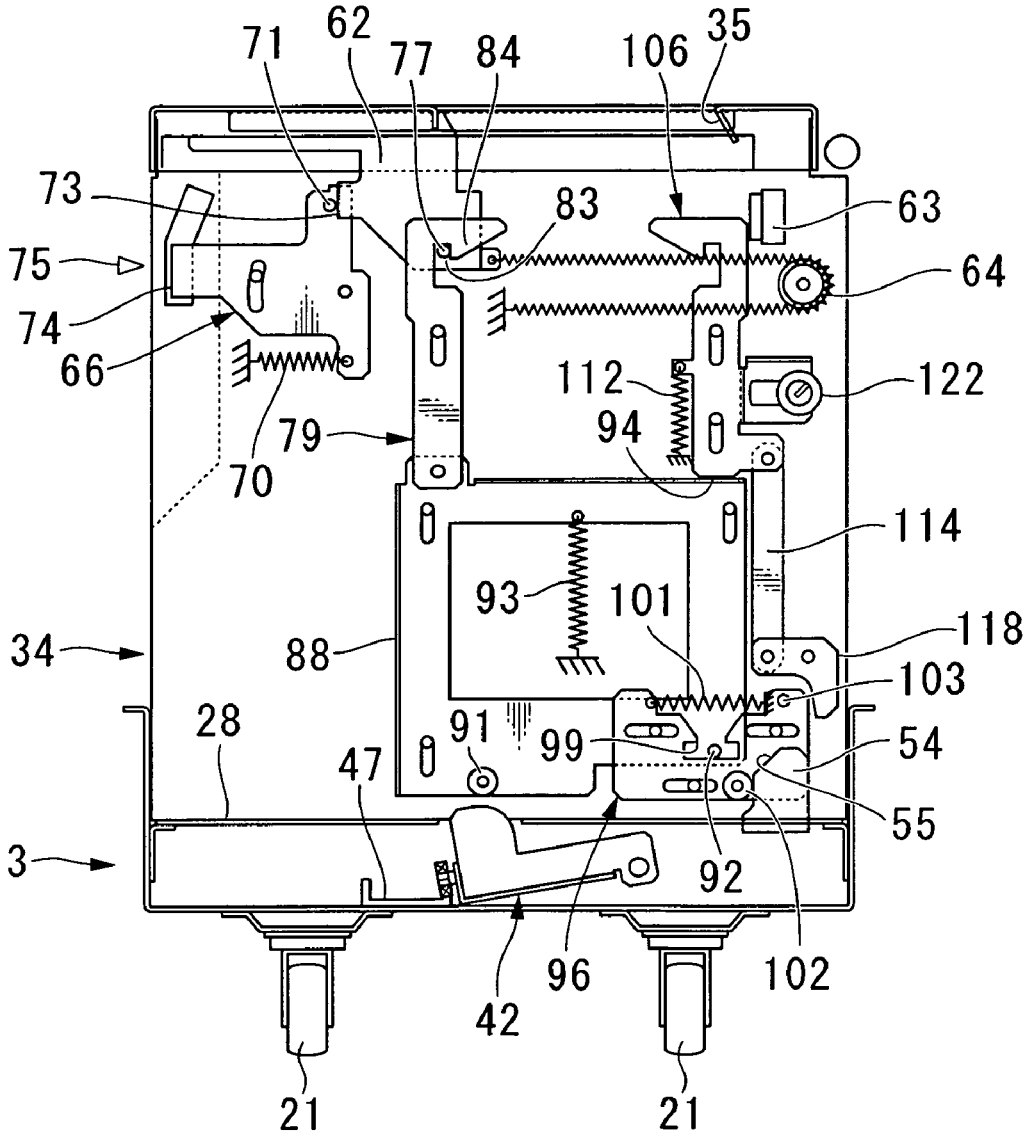
FIG. 9 is a cross section of a rear view showing the carriage section and the container box of the coin deposit apparatus immediately after attaching the container box thereto according to the embodiment of the present invention.

From this state, as shown in FIG. 9, when the container box 34 is mounted onto the detachable section 28 of the carriage section 3 from above, the attached-state-lock-releasing pieces 54, 54 protruding above the carriage section 3 enter into the container box 34 and an inclination surface 55 thereof compresses the movable roller 102 and slides the releasing-movement locking member 96 while resisting the force applied by the spring 101, the pin 92 is separated from the engaging convex section 99, and the pin 92 is located in a central portion of the insertion-opening section 100. By doing this, limitations to the upward movements of the open-position-locking member 79 and the movable plate 88 by the releasing-movement locking member 96 are released, and the state is maintained in which the pin 77 of the shutter 62 engages with the engaging concave section 83 by the force applied by the movable-plate spring 93. That is, when the container box 34 is attached to the attached-state-lock-releasing pieces 54, 54 disposed on the detachable section 28 of the carriage section 3, in connection with this attaching, the attached-state-lock-releasing pieces 54, 54 engage with the releasing-movement locking member 96 of the container box 34; thus, the locked state of the movable plate 88 by the releasing-movement locking member 96 is released.

Accordingly, when the carriage section 3 is attached to the apparatus main body 2 in a state where the container box 34 is attached to each detachable section 28 of the carriage section 3, a control section, not shown in the drawings, of the apparatus main body 2 detects as to whether the shutter 62 of the container boxes 34 of all the carriage sections 3 is in the open state, i.e., whether all the detecting piece sections 74 of the shutter-position detecting member 66 of the carriage sections 3 have descended by using a sensor 75. Since the shutter-position detecting member 66 locates the detecting piece section 74 at a lower detection position by contacting the operational piece section 73 of the shutter 62 only when the shutter 62 is in the open position, if all the detecting piece sections 74 of the shutter-position detecting member 66 of the carriage section 3 have descended, the control section acknowledges that all the shutters 62 of the carriage section 3 are locked in the open positions by the open-position-locking member 79, and locks the carriage section 3 attached to the apparatus main body 2 undetachably by engaging the carriage-locking section 31 shown in FIG. 3 with the locking concave section 30 of the front plate section 23 of the carriage section 3.

Furthermore, a warning section for sounding an alarm, not shown in the drawings, is disposed in the control section so that the alarm is sounded from the warning section when the detection using a plurality of sensors 75 indicates that any one of the shutters 62 of the container boxes 34 is not in the open position.

As explained above, the carriage section 3 having the detachable sections 28, 28, 28 onto each of which the container box 34 having the opened upper aperture 35 is attached to the apparatus main body 2 and locked by the carriage-locking section 31, as shown in FIG. 1, each container box 34 is disposed beneath the corresponding temporary storage sections 16, 16, 16 of the apparatus main body 2, and after that, each container box 34 receives the coins from the temporary storage sections 16, 16, 16 and encloses them.

Figure 10A:
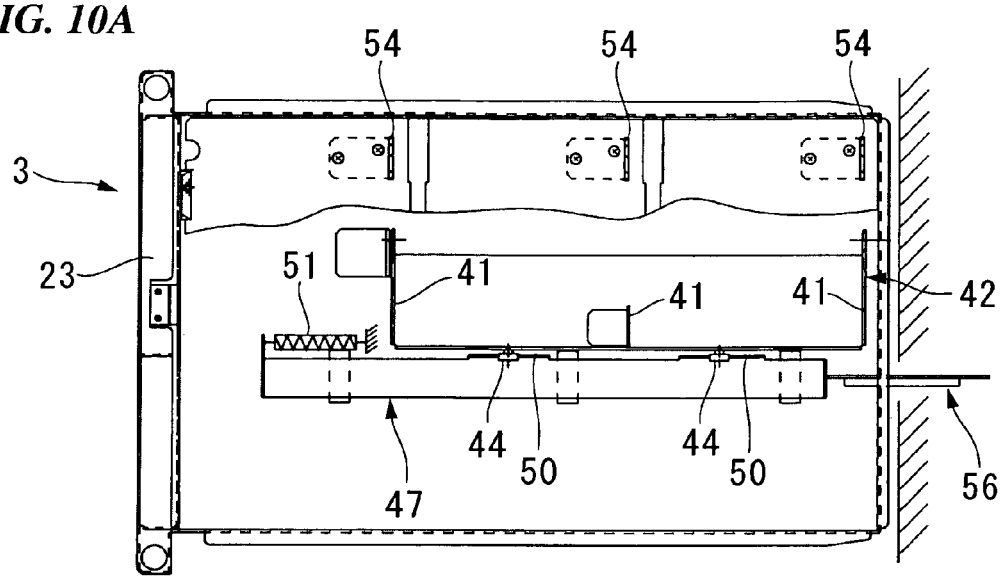
FIGS. 10A to 10C show a state in which lock-release driving pieces of the coin deposit apparatus are driven in the embodiment of the present invention.
Figure 10B:
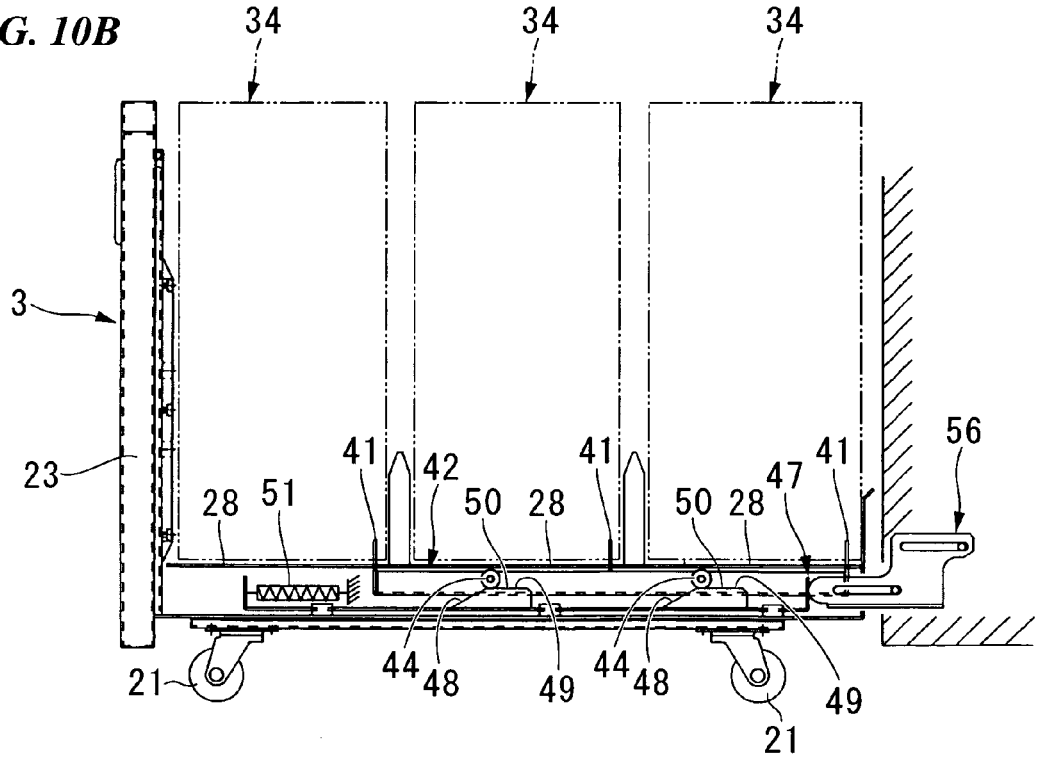
Figure 10C:
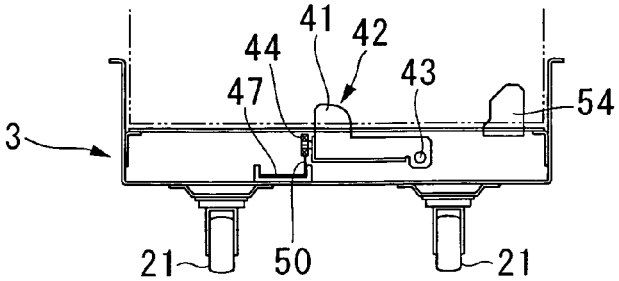

On the other hand, in a case where the coins are collected from the container boxes 34 in which the coins have been enclosed, when the control section, not shown in the drawings, slides the lock-release driving pieces 56, 56 disposed in the apparatus main body 2 as shown in FIG. 3 toward the carriage section 3, these lock-release driving pieces 56, 56 compress the sliding piece 47 and slide thereof as shown in FIG. 10. Consequently, the rollers 44 of the lock-releasing member 42 override the cam sections 50 of the sliding piece 47, and the lock-releasing member 42 rotates around the rotational shaft 43 and moves all the lock-releasing piece sections 41, 41, 41 upward. Consequently, each lock-releasing piece section 41 enters into the container box 34 correspondingly one by one.

Figure 11:
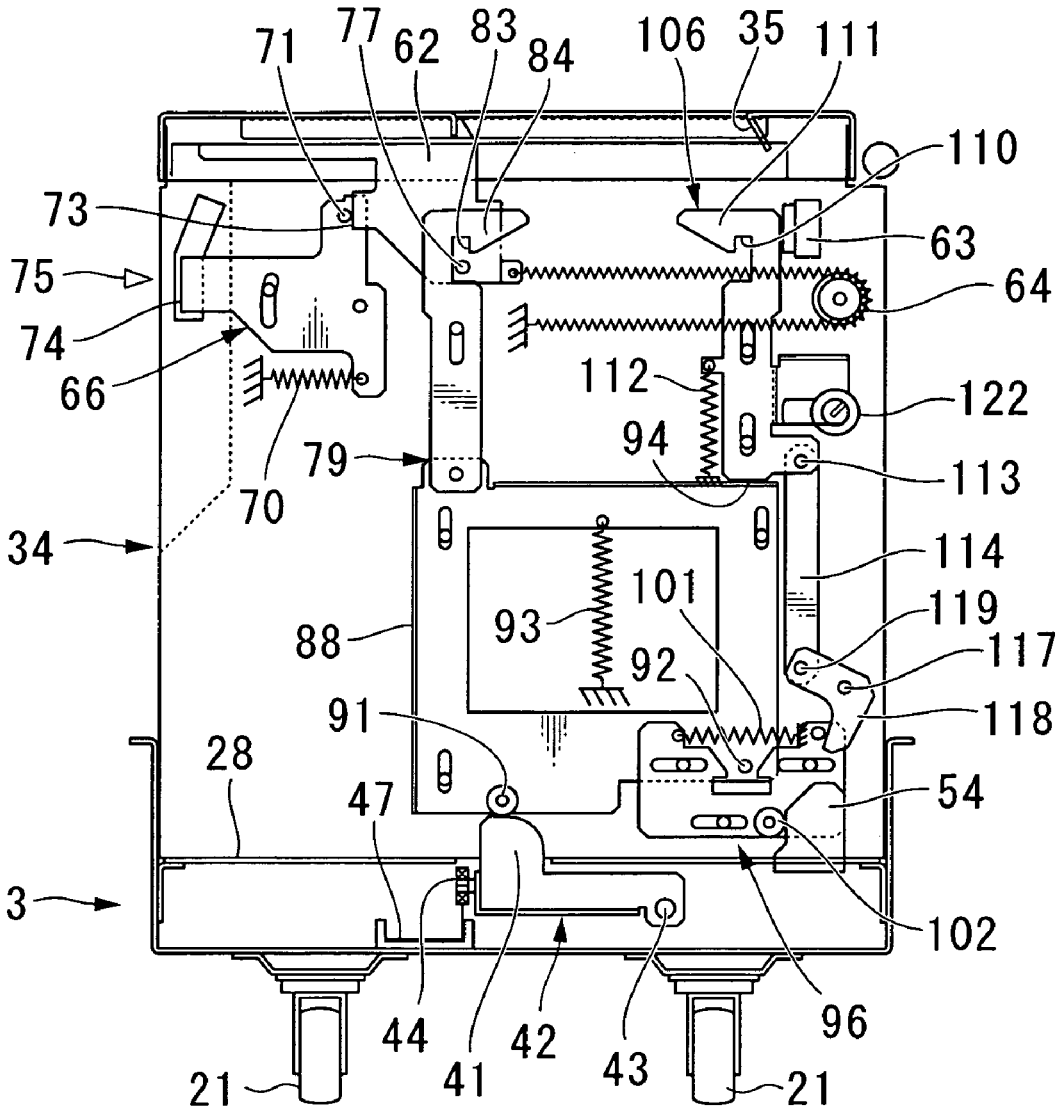
FIG. 11 is a cross section of a rear view showing the carriage section and the container box of the coin deposit apparatus in a state in which the lock-release driving pieces are driven according to the embodiment of the present invention.

If the lock-releasing piece section 41 enters into the container box 34 as shown in FIG. 11, the lock-releasing piece section 41 contacts the movable roller 91 of the movable plate 88 and pushes upward thereof. Consequently, as explained above, since the releasing-movement locking member 96 of the container box 34 mounted onto the carriage section 3 does not lock the movable plate 88, the movable plate 88 and the open-position-locking member 79 are raised. By doing this, the hook section 84 of the open-position-locking member 79 disengages from the pin 77 of the shutter 62 upwardly, and as a result of that, the locked state of the shutter 62 by the open-position-locking member 79 is released. That is, each lock-releasing piece section 41, disposed on each one of the detachable sections 28, 28, 28, engages with the movable plate 88 of the mounted container box 34 onto which the lock-releasing piece section 41 is mounted, and releases the locked state of the shutter 62 in the open position by the movable plate 88 and the open-position-locking member 79. Also, the contacting section 94 pushes the closed position locking member 106 upwardly by raising of this arising movable plate 88. As a result of that, the closed position locking member 106 lifts the hook section 111 higher than the pin 77 of the shutter 62.

Figure 12:
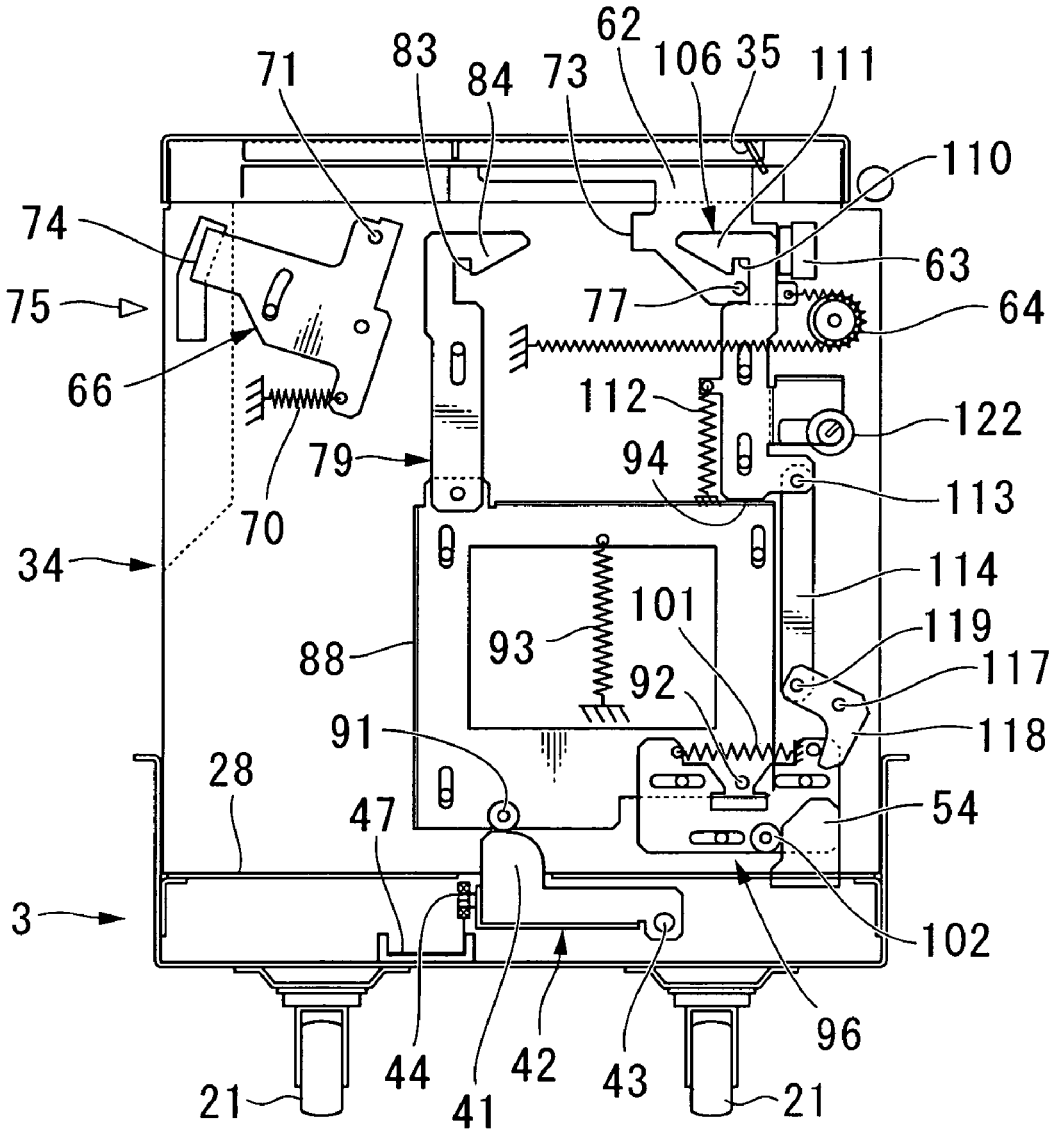
FIG. 12 is a cross section of a rear view showing the carriage section and the container box of the coin deposit apparatus in a state next to the driving of lock-release driving pieces according to the embodiment of the present invention.

The shutter 62 of which the locked state by the open-position-locking member 79 is released in the above manner closes the upper aperture 35 by the force applied by the shutter spring 64 as shown in FIG. 12 and the shutter 62 is moved to the closed position contacting the stopper 63. By doing this, the pin 77 of the shutter 62 is located vertically beneath the engaging concave section 110 of the closed position locking member 106.

Figure 13:
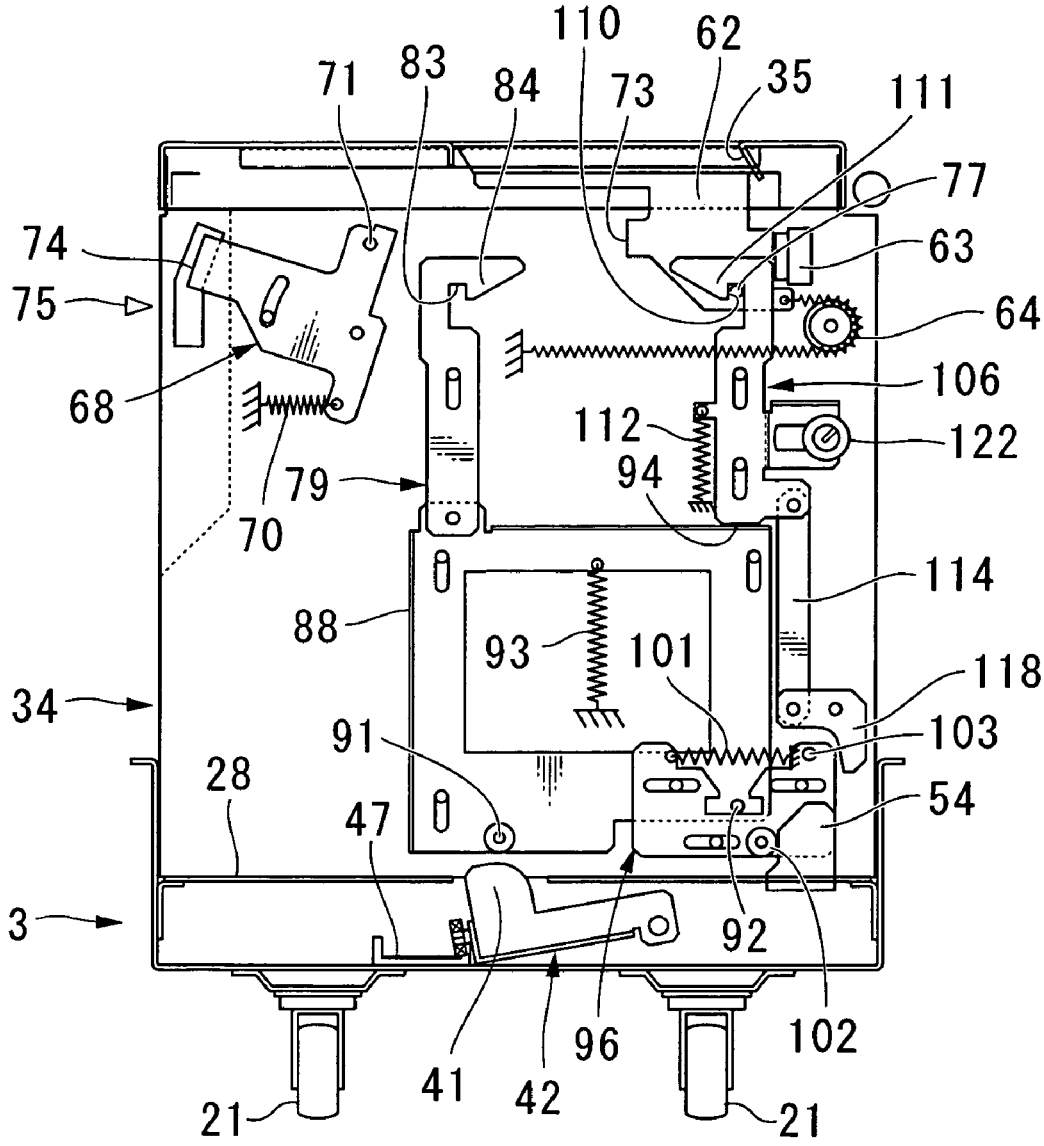
FIG. 13 is a cross section of a rear view showing the carriage section and the container box of the coin deposit apparatus immediately after the driving of lock-release driving pieces are stopped according to the embodiment of the present invention.

In this state, the shutter-position detecting member 66 rotates by the force applied by the spring 70 when the shutter 62 is separated therefrom; thus, the detecting piece section 74 is not detected by the sensor 75. By doing this, the shutter-position detecting member 66 detects that the shutter 62 is in a closed state. Consequently, after the locked state of the shutter 62 by the open-position-locking member 79 is released as explained above, the lock-release driving pieces 56, 56 return to the apparatus main body 2 at a timing of locating the shutter 62 in the closed position as shown in FIG. 3; as a result of that, the sliding piece 47 is returned by the force applied by the sliding spring 51, the lock-releasing piece section 41 descends as shown in FIG. 13, and furthermore, the movable plate 88 and the open-position-locking member 79 descend by their own weight and the force applied by the movable-plate spring 93. By doing this, also the closed position locking member 106 contacting the contacting section 94 descends by its own weight and the force applied by the spring 112. As a result of that, the pin 77 of the shutter 62 engages with the engaging concave section 110 of the closed position locking member 106, and the closed position locking member 106 locks the shutter 62 in the closed position.

According to the above-explained process, the lock-release driving pieces 56, 56 of the apparatus main body 2 move the shutter 62 to the closed position by the shutter spring 64 by operating the sliding piece 47 and the lock-releasing member 42 of the carriage section 3 and releasing the locked state of the shutter 62 at the open position by the movable plate 88 and the open-position-locking member 79. Also, the lock-release driving pieces 56, 56 place the closed position locking member 106 under the locked condition after moving it to the closed position of the shutter 62.

In addition, even if the closed position locking member 106 is raised as explained above, it does not affect the key cylinder 122 at all. Also, although the releasing piece 118 rotates via the link 114 if the closed position locking member 106 is raised, since the releasing-movement locking member 96 separates the pin 103 from the releasing piece 118 by the attached-state-lock-releasing pieces 54, 54 nearer the carriage section 3, the releasing piece 118 does not make contact to anything.

In this state, the control section releases the locked state of the carriage section 3 attached to the apparatus main body 2 by the carriage-locking section 31 when the detection by a plurality of sensors 75 indicates that the shutter 62 in all the container boxes 34 is not in the open position. In contrast, if the detection indicates that the shutter 62 of any one of the container boxes 34 is in the open position, the control section acknowledging that there is a problem in closing movement of the shutter 62 for some reason does not release the locked state of the carriage section 3 attached to the apparatus main body 2 by the carriage-locking section 31 and sounds an alarm in the warning section.

When the locked state of the carriage section 3 attached to the apparatus main body 2 by the carriage-locking section 31 is released, the control section makes the warning section, not shown in the drawings, notify that it is possible to detach the carriage section 3. Consequently, the container box 34 is drawn out and detached from the apparatus main body 2 together with the carriage section 3 and transported to a predetermined collection location by the rotating castors 21. During this period, since the upper aperture 35 of all the container boxes 34 is closed by the shutters 62, and in addition, the shutter 62 is locked by the closed position locking member 106, problems in security management are prevented from occurring.

Figure 14:
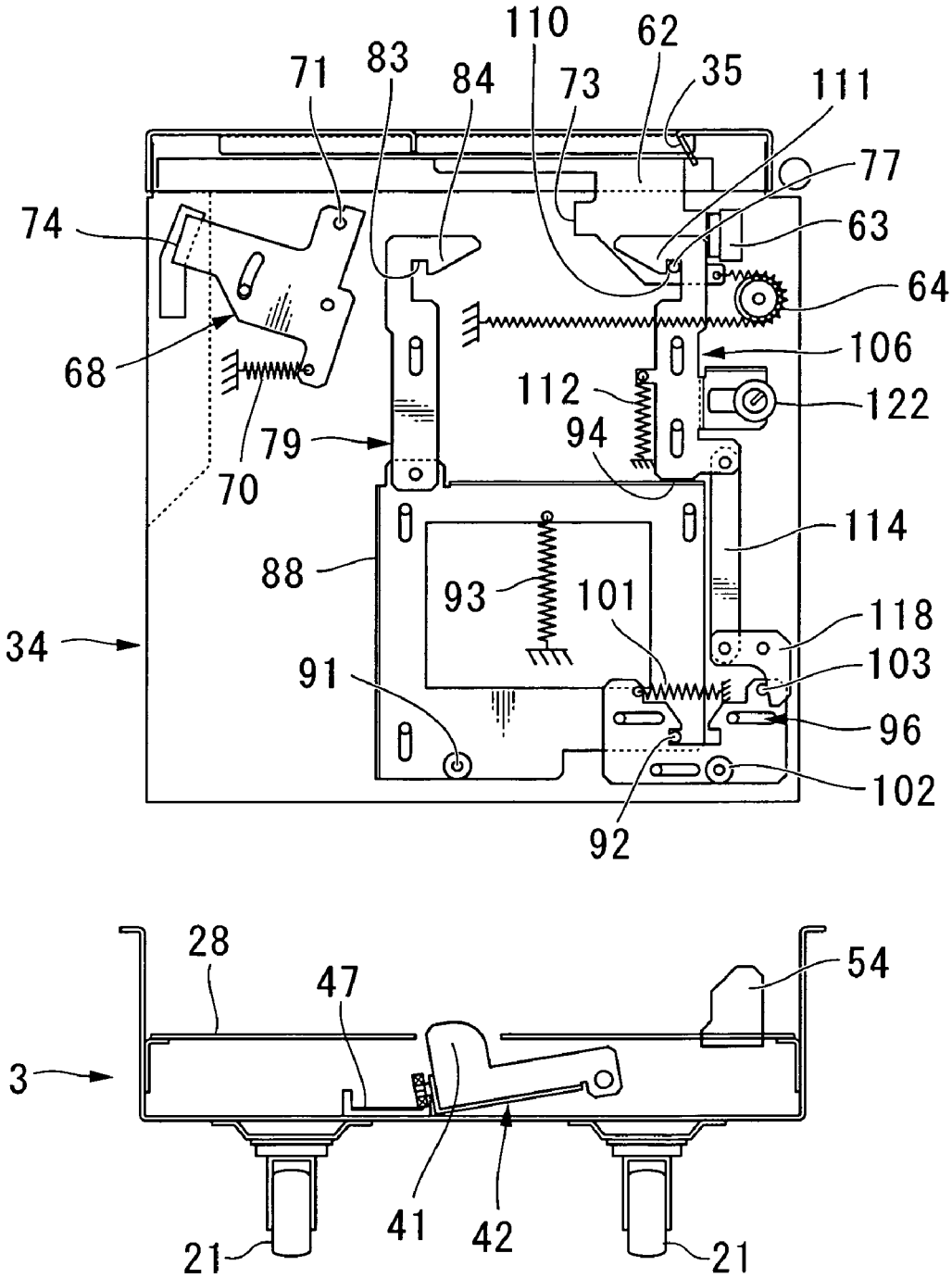
FIG. 14 is a cross section of a rear view showing the carriage section and the container box of the coin deposit apparatus after detaching the container box according to the embodiment of the present invention.

As shown in FIG. 14, the container box 34 is detached from the carriage section 3 at the predetermined collection location. Consequently, since the attached-state-lock-releasing pieces 54, 54 are separated from the container box 34, the releasing-movement locking member 96 engages the pin 92 with the engaging convex section 99 by the force applied by the spring 101. As a result of that, the upward movement of the pin 92 is limited by an upper surface of the engaging convex section 99, and the shutter 62 is double-locked by limiting the upward movements of the movable plate 88 and the open-position-locking member 79.

Figure 15:
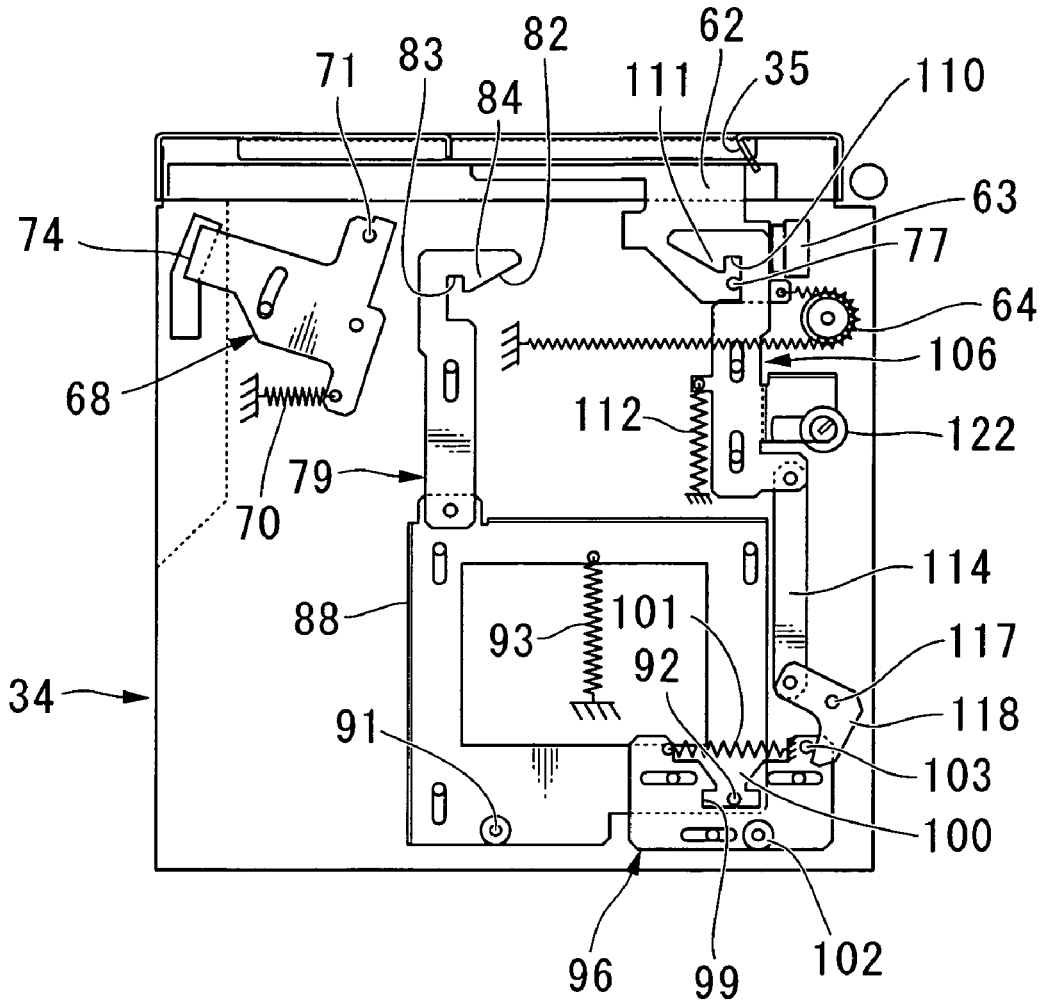
FIG. 15 is a side view of a cross section of the container box of the coin deposit apparatus in a state in which the locked state is released by a key cylinder according to the embodiment of the present invention.

Consequently, an operator having a key operates the key cylinder 122 and lifts the closed position locking member 106 engaging with this as shown in FIG. 15. By doing this, since the engaging concave section 110 of the closed position locking member 106 separates from the pin 77 of the shutter 62, and the locked state of the shutter 62 at the closed position is released, the shutter 62 is maintained in the closed position only by the force applied by the shutter spring 64. If the closed position locking member 106 is lifted in this state, the releasing piece 118 rotates via the link 114, the releasing-movement locking member 96 is slid via the pin 103, the pin 92 of the movable plate 88 is separated from the engaging convex section 99, and the pin 92 is located in a central position of the insertion-opening section 100. Consequently, since the locked state of the movable plate 88 and the open-position-locking member 79 is released, and they are located by their own weight and the force applied by the movable-plate spring 93, if the shutter 62 is slid to the open position manually by resisting the force applied by the shutter spring 64, the open-position-locking member 79 and the movable plate 88 are lifted while resisting the force applied by the movable-plate spring 93 by contacting the pin 77 onto the lower inclination surface 82 of the open-position-locking member 79, and if they exceed the position of the hook section 84, the open-position-locking member 79 and the movable plate 88 descend by their own weight and the force applied by the movable-plate spring 93; as a result of that, the pin 77 engages with the engaging concave section 83. By doing this, the shutter 62 is locked in the open position. That is, the link 114 and the releasing piece 118 release the locked state between the movable plate 88 and the open-position-locking member 79 by the releasing-movement locking member 96 sequentially with the releasing of the locked state of the shutter 62 in the closed position by the closed position locking member 106.

Consequently, after collecting the coins from the container box 34 by an arbitrary method, when the operator releases the upward movement of the closed position locking member 106 by operating the key cylinder 122 as if extracting the key from there, as shown in FIG. 7, the closed position locking member 106 descends by its own weight and the force applied by the spring 112, and the releasing piece 118 returns via the link 114. Consequently, the releasing-movement locking member 96 compressed and slid by the releasing piece 118 engages the pin 92 of the movable plate 88 with the engaging convex section 99 by the force applied by the spring 101. As a result of that, the upward movement of the pin 92 is limited by an upper surface of the engaging convex section 99, and the shutter 62 is double-locked by limiting the upward movements of the movable plate 88 and the open-position-locking member 79. From this state, the container boxes 34 are mounted onto the carriage section 3 in order to attach them to the apparatus main body 2 again.

According to the coin deposit apparatus 1 of the present embodiment as explained above, although the coins are stored in a plurality of the container boxes 34, 34, 34 after distributing the acceptable coins by the distribution sections 13, 13, 13 and storing the coins in the plurality of the temporary storage sections 16, 16, 16, since the container box is mounted onto the carriage section 3 detachably, which has castors and is attachable and detachable with respect to the apparatus main body 2, it is possible to detach the container boxes 34, 34, 34 together with the carriage section 3 and transport to desirable locations easily by running the carriage section 3 on the castors 21. During such transportation, since the lock-release driving pieces 56, 56 disposed in the apparatus main body 2 move the shutters 62 which can open and close the upper openings 35 of the container boxes 34 mounted on the carriage section 3 to the closed position, and since the shutters 62 are locked in the closed positions by the closed position locking member 106, the shutters 62 can be locked so that the upper aperture 35 of the container boxes 34 is shut; therefore, it is possible to prevent problems in security management if the locked state of the carriage section 3 attached to the apparatus main body 2 by the carriage-locking section 31 is released consequently.

More specifically, since the upper aperture 35 of the container box 34, mounted on the carriage section 3, having the shutter 62 locked in the open position by the open-position-locking member 79 is open, it is possible to retrieve the coins from the temporary storage sections 16, 16, 16. On the other hand, if the lock-release driving pieces 56, 56 of the apparatus main body 2 move the lock-releasing member 42 via the sliding piece 47 of the carriage section 3, the lock-releasing piece section 41 of the lock-releasing member 42 engages with the movable roller 91 of the movable plate 88 of the container box 34, and the locked state of the shutter 62 in the open position by the open-position-locking member 79 is released. Accordingly, the shutter spring 64 moves the shutter 62 to the closed position, the lock-release driving pieces 56, 56 return to the apparatus main body 2 and descend the closed position locking member 106 by its own weight and the force applied by the spring 112 after moving the shutter 62 to the closed position in this manner, and the shutter 62 is locked in the closed position. After that, if the locked state of the carriage section 3 attached to the apparatus main body 2 by the carriage-locking section 31 is released, it is possible to prevent a problem in security management occurring. In addition, if the lock-release driving pieces 56, 56 disposed nearer to the apparatus main body 2 are moved, this movement engages the lock-releasing piece section 41 of the lock-releasing member 42 with the movable plate 88 via the sliding piece 47 of the carriage section 3, and the locked state of the shutter 62 in the open position is released. As a result of that, the shutter 62 can be moved to the closed position by the force applied by the shutter spring 64 and locked there. Therefore, the shutter which has previously been disposed in the open position can be locked in the moved position by a simple structure.

Furthermore, since each releasing-movement locking member 96 disposed in a plurality of container boxes 34 locks the lock-release movements by the open-position-locking member 79 and the movable plate 88, the open state of the shutter 62 in the container box detached from the carriage section 3 and having the shutter 62 is double-locked by the open-position-locking member 79, the movable plate 88, and the releasing-movement locking member 96; therefore, the shutter 62 in the open state does not close for unexpected reasons, e.g., collision and erroneous operation. Also, if the container box 34 is attached to the detachable section 28 of the carriage section 3, since this releasing-movement locking member 96 engages with the attached-state-lock-releasing pieces 54, 54 of the carriage section 3 and the locked state is released, it is possible to release the locked state sequentially with the attaching movement of the container box 34. After releasing the locked state, since the shutter 62 is locked only by the open-position-locking member 79, the locked state of the shutter 62 in the open position by the foregoing open-position-locking member 79 can be released by the lock-release driving pieces 56, 56.

When the detection by the sensor 75 of the shutter-position detecting member 66 disposed in each one of a plurality of the container boxes 34 indicates that the shutter 62 of all the container boxes 34 attached to the detachable section 28 of the carriage section 3 is in the open position, since the control section of the apparatus main body 2 locks the carriage section 3 attached to the apparatus main body 2 by the carriage-locking section 31, in a case, for example, where a vacant container box 34 is attached to the apparatus main body 2 via the carriage section 3, if the carriage section 3 is locked to the apparatus main body 2, all the container boxes 34 have the shutter 62 in the open state; therefore, the coins can be retrieved. In this way, the carriage section 3 can be locked to the apparatus main body 2 only if coins can be retrieved in a state where the shutters 62 in all the container boxes 34 are open.

Also, if the detection by the plurality of sensors 75 does not indicate that the shutter 62 of any one of the container boxes 34 is in the open position, the operator can be notified by sounding an alarm from the warning section.

If the detection by the sensor 75 of the shutter-position detecting member 66 disposed in each one of a plurality of the container boxes 34 indicates that the shutter 62 of all the container boxes 34 is not in the open position, the control device of the apparatus main body 2 releases the locked state of the carriage section 3 attached to the apparatus main body 2 by the carriage-locking section 31, for example, even if the lock-release driving pieces 56, 56 of the apparatus main body 2 release the locked state of the shutter 62 in the open position by the open-position-locking member 79 of the container boxes 34 in order to collect the container boxes 34, it is acknowledged that the closing operation of the shutter 62 is not carried out desirably when the shutter 62 of any one of the container boxes 34 is in the open position, and an alarm is sounded; thus, the operator can acknowledge this alarm reliably.

In addition, when the control section releases the locked state of the carriage section 3 attached to the apparatus main body 2 by the carriage-locking section 31, the control device notifies that it is possible to detach the carriage section 3; therefore, the operator can acknowledge this reliably. Accordingly, the container boxes 34 mounted onto the carriage section 3 can be moved to a predetermined location immediately; thus it is safe.

Furthermore, the shutter 62 can be opened by taking out the container box 34 having the shutter 62 in a locked state from the apparatus main body 2 via the carriage section 3, and, by moving it to a desirable location by, for example, the carriage section 3, and after that, by releasing the locked state of the shutter 62 in the closed position by the closed position locking member 106 by the key cylinder 122 which can be operated externally; thus, the coins in the container boxes 34 can be collected. Also, if the locked state of the closed position locking member 106 is released by the key cylinder 122, since the locked state of the releasing-movement locking member 96 which locks the open-position-locking member 79 and the movable plate 88 is released sequentially with this releasing, the open-position-locking member 79 and the movable plate 88 can be moved; therefore, the opened shutter 62 can be locked in an open state.

What is claimed is:

1. A coin deposit apparatus comprising:

a separating-supplying section for transporting a group of coins separately, the group of coins being deposited one at a time;

an identifying section for identifying the type of coin transported by the separating-supplying section;

an eliminating section for eliminating coins rejected based on the identification results made by the identifying section;

a distribution section for distributing coins identified as acceptable based on the identification results made by the identifying section;

a plurality of temporary storage sections for storing the coins, distributed by the distribution section, temporarily therein;

a plurality of container sections having upper openings for receiving the coins from a plurality of the temporary storage sections, the received coins being contained in the container sections;

a carriage section detachable from a main body of the apparatus, the carriage section having castors, a plurality of the container sections being mounted onto the carriage section detachably; and a carriage-locking section capable of locking the carriage section attached to the apparatus main body, wherein each one of a plurality of the container sections is provided with a shutter capable of opening and shutting the upper opening and a closed position locking member for locking the shutter in a closed position, and a shutter-locking activating section is provided in the apparatus main body so that each shutter of the plurality of the container sections mounted on the carriage section is moved to the closed position, and the shutter is locked in the closed position by the closed position locking member, wherein:

each one of the plurality of the container sections is provided with a force-applying section for moving the shutter to the closed position by applying a force and an open-position-locking member for locking the shutter in an open position, the carriage section is provided with a plurality of detachable sections onto each of which the container section is mounted respectively, each detachable section being provided with a pre-collection lock-releasing section which engages with the open-position-locking member of the container section, and the pre-collection lock-releasing section being capable of releasing the shutter locked in an open position by the open-position-locking member, the shutter-locking activating section of the apparatus main body moves the shutter to the closed position by the force-applying section by activating the pre-collection lock-releasing section of the carriage section and releasing the locked state of the shutter locked in the open position by the open-position-locking member, each one of the plurality of the container sections is provided with a releasing-movement locking section for locking the releasing of the locked state of the open-position-locking member, each one of the plurality of the detachable sections of the carriage section is provided with an attached-state-lock-releasing section for releasing the locked state of the releasing-movement locking section by engaging the attached-state-lock-releasing section with the releasing-movement locking section of the container section by attaching the container section to the detachable section, each one of the plurality of the container sections is provided with a shutter-position detecting member, positioned at a detection position, contacting a part of the shutter when the shutter is in an open position, the apparatus main body is provided with a plurality of detecting sections for detecting as to whether the shutter-position detecting member of the plurality of the container sections mounted on the carriage section is positioned at the detection position; and a control section for locking the carriage section attached to the apparatus main body by the carriage-locking section if the positions of the shutters of all the container sections are detected in the open positions by a plurality of the detecting sections, the control section is provided with a warning section for sounding an alarm if the detection by a plurality of the detecting sections indicates that any one of the shutters of the container sections is not in the open position, and the control section releases the locked state between the carriage section and the apparatus main body by the carriage-locking section if the detection by a plurality of the detecting sections indicates that the shutters of all the container sections are not at the open positions.

2. A coin deposit apparatus according to claim 1, wherein the control section is provided with a notifying section for notifying that the carriage section may be taken out if the locked state between the carriage section and the apparatus main body by the carriage-locking section is released.

3. A coin deposit apparatus according to claim 1, wherein each one of the plurality of the container sections is provided with a key section capable of engaging with the closed position locking member; capable of releasing the locked state of the shutter at the closed position by the closed position locking member; and capable of being controlled externally.

4. A coin deposit apparatus according to claim 1, wherein each one of the plurality of the container sections is provided with a key section capable of engaging with the closed position locking member, capable of releasing the locked state of the shutter in the closed position by the closed position locking member, and capable of being controlled externally; and a connecting section for releasing the locked state of the open-position-locking member by the releasing-movement locking section in connection with releasing the locked state of the shutter in the closed position by the closed position locking member.

* * * * *